US009587851B2

(12) United States Patent
Wu et al.

(10) Patent No.: US 9,587,851 B2
(45) Date of Patent: Mar. 7, 2017

(54) DEHUMIDIFIER AND FLOAT ASSEMBLY THEREOF

(71) Applicant: TCL Air Conditioner (Zhongshan) Co., Ltd., Zhongshan (CN)

(72) Inventors: Xiongfeng Wu, Zhongshan (CN); Xianxiong Zhang, Zhongshan (CN)

(73) Assignee: TCL AIR CONDITIONER (ZHONGSHAN) CO., LTD., Zhongshan (CN)

( * ) Notice: Subject to any disclaimer, the term of this patent is extended or adjusted under 35 U.S.C. 154(b) by 165 days.

(21) Appl. No.: 14/586,324

(22) Filed: Dec. 30, 2014

(65) Prior Publication Data

US 2016/0061484 A1 Mar. 3, 2016

(30) Foreign Application Priority Data

Aug. 28, 2014 (CN) ..... 2014 2 0490971 U

(51) Int. Cl.

| | |
|---|---|
| ***F16K 31/24*** | (2006.01) |
| ***F24F 13/22*** | (2006.01) |
| ***F04F 10/00*** | (2006.01) |
| ***F24F 3/14*** | (2006.01) |

(52) U.S. Cl.

CPC ..... *F24F 13/222* (2013.01); *F04F 10/00* (2013.01); *F24F 3/1405* (2013.01); *F24F 2003/1446* (2013.01); *Y10T 137/2795* (2015.04); *Y10T 137/7488* (2015.04)

(58) Field of Classification Search

CPC ..... F24F 13/222; F24F 3/1405; F24F 2003/1446; F04F 10/00; B01D 53/265; Y10T 137/7481; Y10T 137/7485; Y10T 137/2754; Y10T 137/2768; Y10T 137/2795

USPC ..... 137/135, 129, 131, 447, 448; 62/288, 62/290, 211, 150, 188

See application file for complete search history.

(56) References Cited

U.S. PATENT DOCUMENTS 2,725,196 A * 11/1955 Trittschuh ..... F24F 3/1405 62/157
3,110,161 A * 11/1963 Maleck ..... F24F 13/22 62/188
4,428,207 A * 1/1984 Hall ..... F24F 3/153 62/176.1
4,554,794 A * 11/1985 Khan ..... F24F 13/222 62/150
4,742,691 A * 5/1988 Kennedy ..... F24F 3/1405 62/150

(Continued)

*Primary Examiner* — Craig J Price
(74) *Attorney, Agent, or Firm* — Hamre, Schumann, Mueller & Larson, P.C.

(57) ABSTRACT

The present invention discloses a dehumidifier and a float assembly thereof, wherein the float assembly comprises a float, a press plate, a suction pipe, and a rotation shaft. The float, the suction pipe, and the press plate are fixedly connected to the rotation shaft respectively, and the suction pipe and the float are arranged at the same side of the rotation shaft, so that the suction pipe is driven by the float to synchronously rise up or fall down along with variation of water level of a water tank; the press plate is driven by the float to control a draining pump to drain when the water tank is at the high water level, thereby realizing automatic drainage. The present invention doesn't need to dispose both a fixed water tank and a movable water tank.

17 Claims, 5 Drawing Sheets

(56) References Cited

U.S. PATENT DOCUMENTS

| | | | | | |
|---|---|---|---|---|---|
| 5,884,495 | A * | 3/1999 | Powell | F24F 1/02 | 62/188 |
| 6,370,902 | B1 * | 4/2002 | De' Longhi | B01D 5/009 | 62/288 |
| 6,415,618 | B1 * | 7/2002 | Sul | F24F 3/153 | 62/188 |
| 7,895,849 | B2 * | 3/2011 | Chiu | F24F 1/025 | 62/150 |
| 7,909,922 | B2 * | 3/2011 | Jang | F24F 13/1406 | 62/115 |
| 9,188,992 | B2 * | 11/2015 | Chiu | G05D 9/04 | |
| 9,278,309 | B2 * | 3/2016 | Tan | B01D 53/265 | |

* cited by examiner

DEHUMIDIFIER AND FLOAT ASSEMBLY THEREOF

TECHNICAL FIELD

The present invention relates to the dehumidifier technology field, in particular, to a dehumidifier and a float assembly thereof.

BACKGROUND

A current dehumidifier usually has two water tanks configured to store condensed water coming from a condenser of dehumidifier, the two water tanks include a fixed water tank and a portable water tank, wherein the fixed water tank is configured to collect the condensed water coming from the condenser directly, and the a draining pipe connected to a water pump is fixedly disposed in the fixed water tank, such that the water in the fixed water tank is drained by the water pump. Furthermore, a higher part of the fixed water tank is provided with an overflow opening, and the overflow opening communicates with the portable water tank; when the drainability of the water pump can't keep up with the condensed water producing ability of the condenser, the condensed water in the fixed water tank rises up to the overflow opening, and overflows to the portable water tank through the overflow opening. A float, which is movable with the variation of the water level, is disposed in the portable water tank, when the water level in the portable water tanker reaches a certain level, the float triggers a microswitch to control the water pump to drain the water.

However, in the current dehumidifier, the water in the fixed water tank can't be cleared completely, which leads to stagnant water and breeding of bacteria. Moreover, it is complicated in structure to dispose two water tanks to store water.

SUMMARY

The main purpose of the present invention is solving the problem that it is troublesome to dispose two water tanks in the existing dehumidifier and the fixed water tank is prone to breed bacteria.

To achieve the above purpose, the present invention provides a float assembly of a dehumidifier, wherein the dehumidifier comprises a housing, a draining pump, and a water tank, the housing comprises a accommodating cavity configured for accommodating the water tank, an outlet configured for allowing the water tank in and out of the housing, a first side wall being opposite to the outlet, and a microswitch mounted on the first side wall and configured to control the draining pump;

wherein, the float assembly comprises a float disposed in the water tank, a press plate configured to trigger the microswitch, a suction pipe communicating with the draining pump and configured to drain the water in the water tank, and a rotation shaft rotatably connected to the housing; the float, the suction pipe, and the press plate are fixedly connected to the rotation shaft respectively, the suction pipe and the float are arranged at the same side of the rotation shaft, so that the suction pipe is driven by the float to synchronously rise up or fall down along with variation of a water level in the water tank; the suction pipe is movable between a first position and a second position, the press plate has a first state in which the press plate leaves the microswitch and a second state in which the press plate presses the microswitch, when the suction pipe moves from the second position to the first position, the press plate changes from the second state to the first state.

Preferably, the float assembly of the dehumidifier further comprises a first connecting part connecting the rotation shaft with the float, the rotation shaft comprises a main section connected to the first connecting part and the press plate, and two pivot sections disposed on two ends of the main section and rotatably connected to the housing; a mounting section configured to fixedly mount the suction pipe is disposed between one pivot section and the main section.

Preferably, the suction pipe is inclined downward with respect to the first connecting part along a direction away from the rotation shaft.

Preferably, the float assembly of the dehumidifier further comprises a suction pipe mounting seat, the suction pipe mounting seat comprises a mounting sleeve engaged with and fixedly connected to the mounting section, a suction pipe mounting seat main body for mounting the suction pipe, the mounting section comprises a side surface engaged with an inner wall of the mounting sleeve, the side surface of the mounting section comprises at least one first plane, and the inner wall of the mounting sleeve comprises a second plane engaged with the first plane.

Preferably, the suction pipe mounting seat main body a baseplate, two side plates, and a mounting groove surrounded by the baseplate and the two side plates and configured to accommodate the suction pipe, at least one side plate comprises a suction pipe limit card extending toward the mounting groove and configured to limit the suction pipe.

Preferably, the accommodating cavity further comprises a top wall, a barb is mounted on the top wall, a top surface of the first connecting part is provided with a hook matched with the barb, and the hook is configured to hang the float on the barb.

Preferably, a bottom surface of the first connecting part is provided with a pushing part, the pushing part comprises a jacking surface that is back to the float, the jacking surface is inclined downward gradually along a direction from the rotation shaft to the float, at least a part of the jacking surface is disposed in the water tank, and the jacking surface is arranged to be pushed by the periphery of the water tank when the water tank is moved from the accommodating cavity to the outlet, such that the hook moves upward to be hung on the barb.

Preferably, an included angle between the press plate and the first connecting part is an acute angle, an upper end of the press plate is connected to the rotation shaft, and a lower end of the press plate is pressed by the water tank to rotate toward the microswitch when the press plate is in the first state and the water tank is moved toward the accommodating cavity.

Preferably, the suction pipe is arranged to make a suction opening of the suction pipe be lower than the water level in the water tank when the float floats on the surface of the water in the water tank.

To achieve the above technical purpose, the present invention further provides a dehumidifier, the dehumidifier comprise any of the float assembly of the dehumidifier mentioned above.

The present invention discloses a dehumidifier and a float assembly thereof, and the float assembly comprises a float disposed in the water tank, a press plate configured to trigger the microswitch, a suction pipe communicating with the draining pump and configured to drain the water in the water tank, and a rotation shaft rotatably connected to the housing. The float, the suction pipe, and the press plate are fixedly connected to the rotation shaft respectively, and the suction pipe and the float are arranged at the same side of the rotation shaft, so that the suction pipe is driven by the float to synchronously rise up or fall down along with the variation of the water level in the water tank; at the same time, the press plate is driven by the float to switch between a first state and a second state along with the variation of the water level in the water tank, and thus controls the draining pump to drain the water when the water tank is at the high water level, thereby realizing automatic drainage. When the water tank is taken out from the accommodating cavity, the float and the suction pipe are separated from the water tank, so it doesn't need to dispose a fixed water tank configured to collect condensed water directly and mount a suction pipe therein and a movable water tank configured to be taken out to pour away water. Therefore, the problem that the water in a fixed water tank can't be completely cleared and may form stagnant water, which may lead to breeding of bacteria, and the problem that it is troublesome to dispose two water tanks, do not exist.

Figure 1:
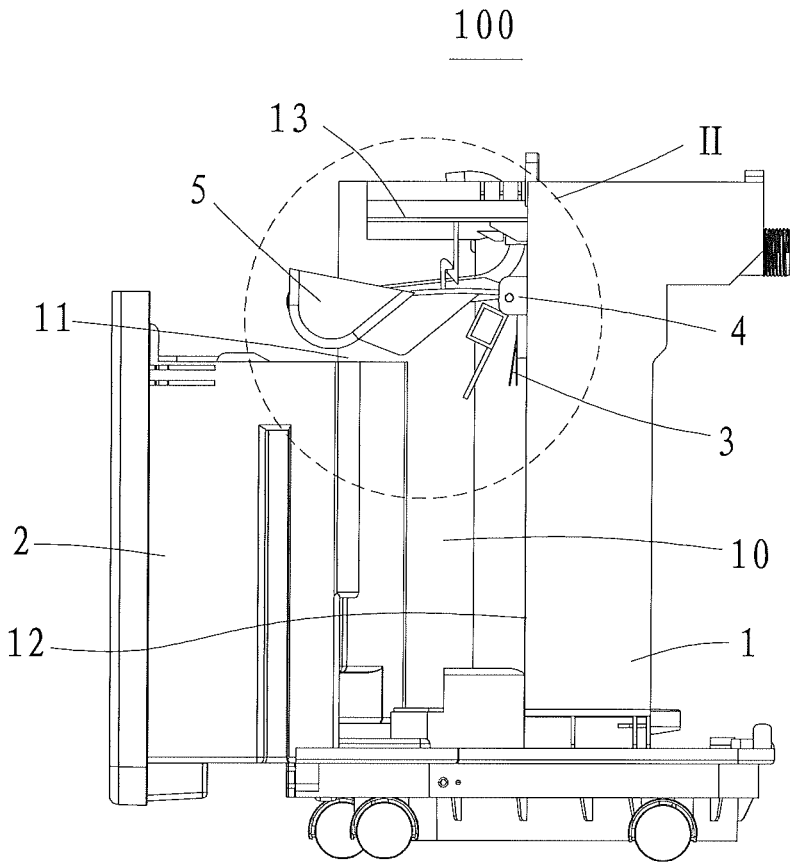
FIG. 1 is a planar structure schematic view of a dehumidifier according to one embodiment of the present invention.

The purpose implementations, functional characteristics, and advantages of the present invention will be further described hereinafter with reference to the accompany drawings and embodiments.

DETAILED DESCRIPTION OF THE PREFERRED EMBODIMENTS

The technical solutions of the present invention are further described hereinafter with reference to the accompany drawings and embodiments. It shall be understood that the embodiments described here are only intended to illustrate but not to limit the present invention.

The present invention provides a dehumidifier and a float assembly thereof, FIGS. 1-6 show the embodiments of the dehumidifier of the present invention.

Referring to FIGS. 1-4, the dehumidifier 100 comprises a housing 1, a draining pump (not shown), and a water tank 2, the housing 1 comprises a accommodating cavity 10 configured to accommodate the water tank 2, an outlet 11 configured for allowing the water tank 2 in and out of the housing 1, a first side wall 12 opposite to the outlet 11, and a microswitch 3 mounted on the first side wall 12 and configured to control the draining pump. In this embodiment, the first side wall 12 is further provided with two opposite rotation shaft mounting seats 4, the two rotation shaft mounting seats 4 are disposed above the microswitch 3, and the accommodating cavity 10 comprises a top wall 13.

Figure 4:
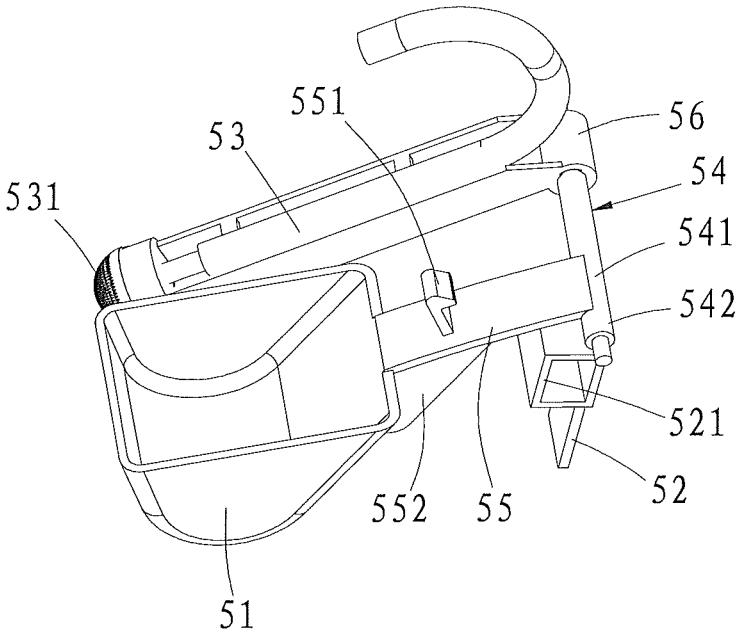
FIG. 4 is a structure schematic view of the float assembly of the dehumidifier shown in FIG. 1.

The float assembly 5 comprises a float 51 disposed in the water tank 2, a press plate 52 configured to trigger the microswitch 3, a suction pipe 53 communicating with the draining pump and configured to drain the water in the water tank 2, and a rotation shaft 54 rotatably connected to the housing 1. Specifically, in this embodiment, the rotation shaft 54 is correspondingly rotatably connected to the two rotation shaft mounting seats 4. The float 51, suction pipe 53, and the press plate 52 are fixedly connected to the rotation shaft 54 respectively, and the suction pipe 53 and the float 51 are arranged at the same side of the rotation shaft 54. As shown in FIG. 4, both the suction pipe 53 and the float 51 are arranged at the left side of the rotation shaft 54, so that the suction pipe 53 is driven by the float 51 to synchronously rise up or fall down along with variation of water level in the water tank 2.

The suction pipe 53 is movable between a first position and a second position, the press plate 52 has a first state in which the press plate 52 leaves the microswitch 3 and a second state in which the press plate 52 presses the microswitch 3, when the suction pipe 53 moves from the second position to the first position, the press plate 52 changes from the second state to the first state.

Figure 2:
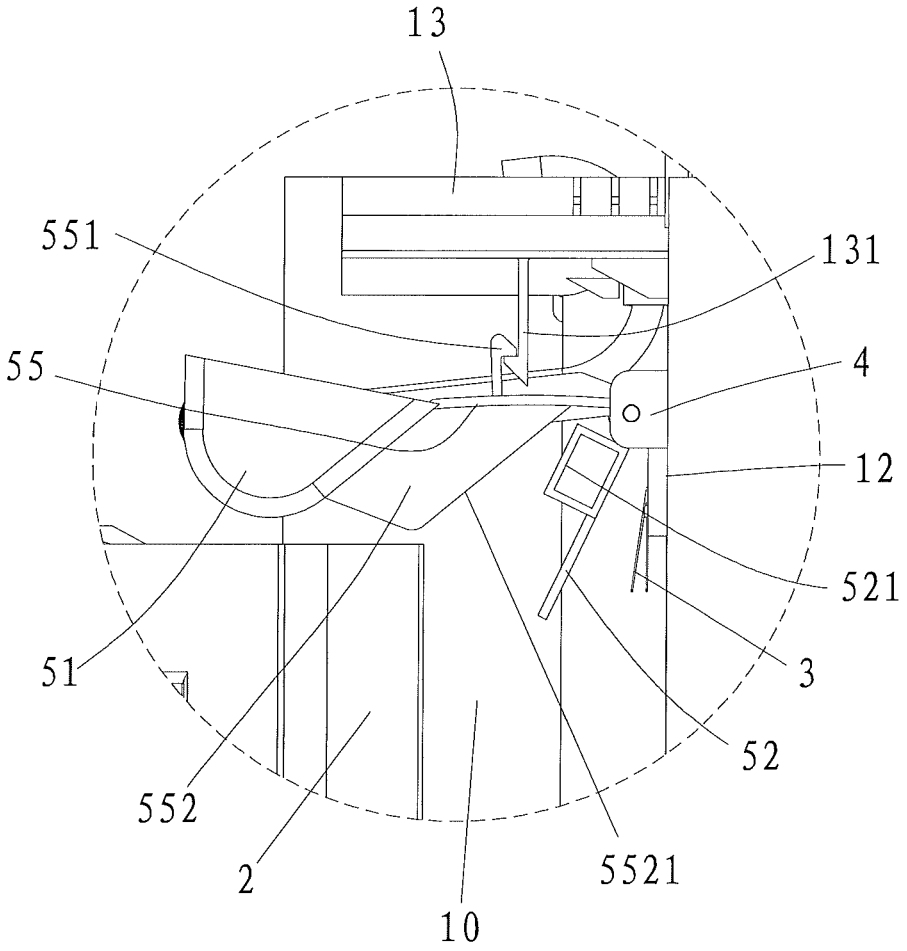
FIG. 2 is an enlarged schematic view of the part (5) shown in FIG. 1.
Figure 5:
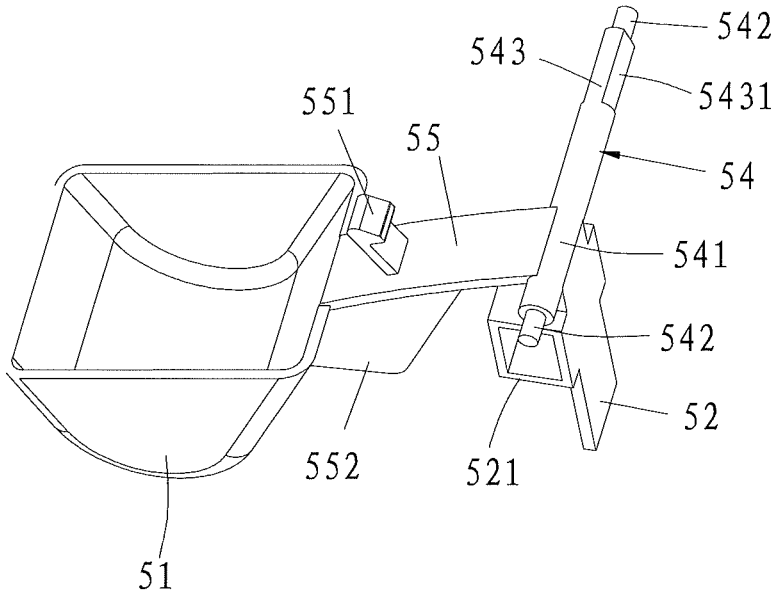
FIG. 5 is a structure schematic view of the float assembly shown in FIG. 4, wherein the suction pipe mounting seat is removed.

Referring to FIGS. 2, 4 and 5, in this embodiment, the float 51 is connected to the rotation shaft 54 through a first connecting part 55, the first connecting part 55 is plate shaped. The float 51 is a casing with an upper opening, and the float 51 may also be a closed casing or a solid object with small density, as long as the float 51 can rise up along with the increasing of the water level and fall down along with the decreasing of the water level. Therefore, the shape and the specific structure of the float 51 are not limited.

The rotation shaft 54 comprises a main section 541 connected to the first connecting part 55 and the press plate 52, and two pivot sections 542 disposed at two ends of the main section 541 and rotatably connected to the housing 1. Specifically, in this embodiment, the two pivot sections 542 are correspondingly rotatably connected to the two rotation shaft mounting seats 4. A mounting section 543 configured to fixedly mount the suction pipe 53 is disposed between one pivot section 542 and the main section 541.

In this embodiment, an included angle between the press plate 52 and the first connecting part 55 is an acute angle, an upper end of the press plate 52 is connected to the rotation shaft 54, and a surface of the press plate 52 which is opposite to the microswitch 3 is provided with a hollow strengthen part 521.

The float 51 extends into the within of the water tank 2 from the top opening of the water tank 2, and when the water in the water tank 2 rises up to the position of the float 51, the float 51 can float on the surface of the water under the action of the water. When the float 51 rises up along with the increasing of the water level in the water tank 2, the first connecting part 55 rotates upward, and the press plate 52 rotates toward a direction away from the microswitch 3; when the water level in the water tank 2 reaches a certain value, the press plate 52 completely leaves the microswitch 3 such that the press plate 52 is in the first state. Because the press plate 52 which presses the microswitch 3 leaves, the microswitch 3 recovers an open state, the control system of the dehumidifier 100 determines that the water in the water tank 2 is about to be full based on the state of the microswitch 3, and may control the draining pump to drain the water immediately or after a predetermined delay which allows the water tank 2 to store more water, thereby realizing automatic drainage.

When the float 51 falls down along with the decreasing of the water level in the water tank 2, the first connecting part 55 rotates downward, and the press plate 52 rotates toward the microswitch 3; when the water level in the water tank 2 decreases to a certain value, the press plate 52 presses the microswitch 3 such that an elastic piece in the microswitch 3 is contacted and the microswitch 3 enters an off state; at this time, the press plate 52 is in the second state. Detecting that the microswitch 3 is turned off, the control system of the dehumidifier 100 controls the draining pump to stop draining water.

Obviously, in this embodiment, the first position of the suction pipe 53 is the position where the suction pipe 53 is driven by the float 51 to rise up when the water level in the water tank 2 increases to a certain value, and the second position of the suction pipe 53 is the position where the suction pipe 53 is driven by the float 51 to fall down when the water level in the water tank 2 decreases to a certain value.

When the water tank 2 is taken out of the accommodating cavity 10, both the float 51 and the suction pipe 53 are separated from the water tank 2, thus it doesn't need to dispose a fixed water tank in which a suction pipe is driven to drain water by a draining pump and a portable water tank configured to be manually taken out to pour away water, thereby avoiding the problem that the water in the fixed water tank can't be cleared completely and may form stagnant water and lead to breeding of bacteria and the problem that it is troublesome to dispose two water tanks.

Obviously, the present invention is not limited to the above structure. In another embodiment (not shown), the included angle between the press plate 52 and the first connecting part 55 is an obtuse angle, a lower end of the press plate 52 is connected to the rotation shaft 54, the first position of the suction pipe 53 is the position where the suction pipe 53 is driven by the float 51 to fall down when the water level in the water tank 2 decreases to a certain value, and the second position of the suction pipe 53 is the position where the suction pipe 53 is driven by the float 51 to rise up when the water level in the water tank 2 increases to a certain value.

In this embodiment, a barb 131 is mounted on the top wall 13, a top surface of the first connecting part 55 is provided with a hook 551, a bottom surface of the first connecting part 55 is provided with a pushing part 552, the pushing part 552 comprises a jacking surface 5521 that is back to the float 51, the jacking surface 5521 is inclined downward gradually along the direction from the rotation shaft 54 to the float 51, and at least a part of the jacking surface 5521 is disposed in the water tank 2.

Figure 3:
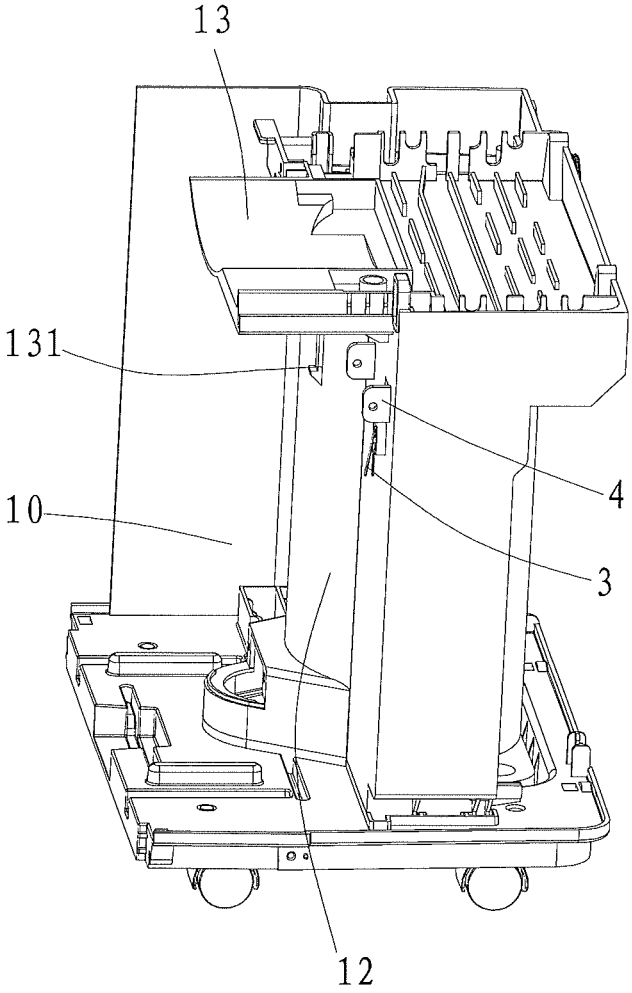
FIG. 3 is a stereochemical structure schematic view of the dehumidifier shown in FIG. 1, wherein the water tank is taken out.

The process of taking out and assembling the water tank 2 of the dehumidifier 100 according to this embodiment is briefly described with reference to FIGS. 1-3.

When the water tank 2 is moved towards the outlet 11 and taken out of the accommodating cavity 10, along with the outward movement of water tank 2, the upper peripheral of the top opening of the water tank 2 (the float 51 and the suction pipe 53 extend into the within of the water tank 2 through the top opening) presses the jacking surface 5521 of the pushing part 552, such that the first connecting part 55 rotates upward (rotates clockwise around the rotation shaft 54 as shown in FIG. 2), the hook 551 of the first connecting part 55 moves upward to be hung on the barb 131, and thus the float assembly 5 is hung on the barb 131.

During the process that the water tank 2 which has been taken out to pour away the water is moved from the outlet 11 to the accommodating cavity 10 to be accommodated in the accommodating cavity 10 again, the water tank 2 will press the lower end of the press plate 52 such that the press plate 52 rotates toward the microswitch 3 (i.e. the counter-clockwise rotation shown in FIG. 2), the first connecting part 55 is driven by the press plate 52 to rotate downward and thereby make the hook 551 move downward and separate from the barb 131.

Figure 6:
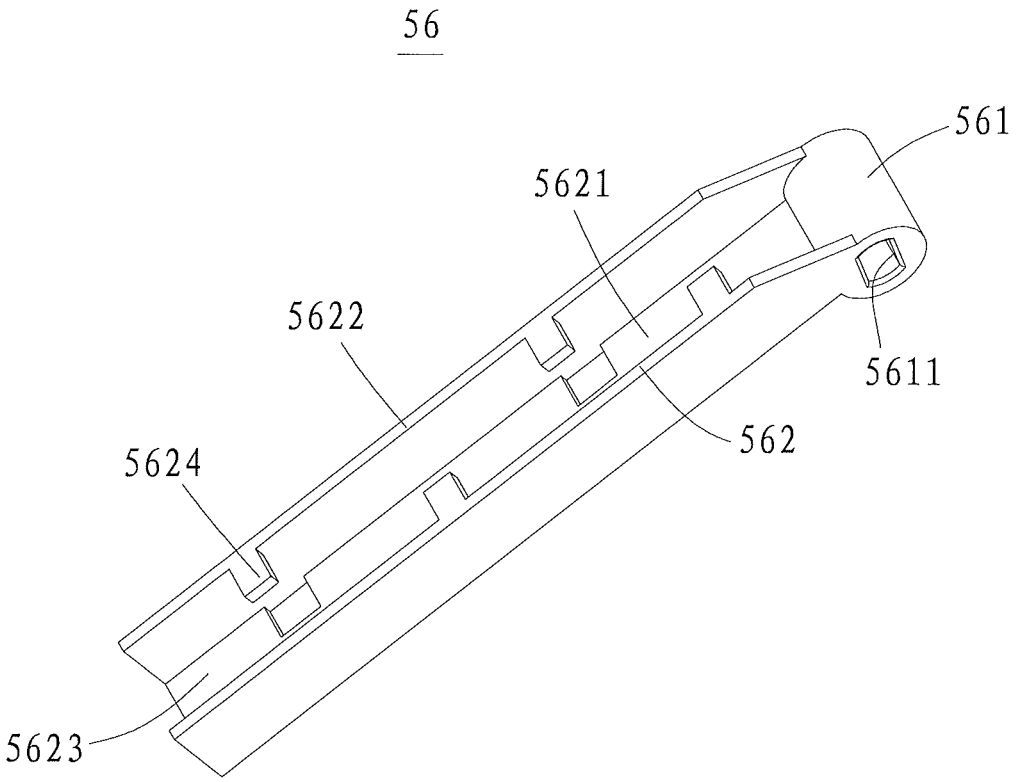
FIG. 6 is a structure schematic view of the suction pipe mounting seat of the float assembly shown in FIG. 4.

Referring to FIGS. 4-6, the float assembly 5 of the dehumidifier 100 further comprises a suction pipe mounting seat 56, the suction pipe mounting seat 56 comprises a mounting sleeve 561 engaged with and fixedly connected to the mounting section 543, and a suction pipe mounting seat main body 562 for mounting the suction pipe 53; the mounting section 543 comprises a side surface engaged with an inner wall of the mounting sleeve 561, the side surface of the mounting section 543 comprises at least one first plane 5431, and the inner wall of the mounting sleeve 561 comprises a second plane 5611 engaged with the first plane 5431.

In assembly, the mounting sleeve 561 of the suction pipe mounting seat 56 passes through the pivot section 542 which is connected to the mounting section 543 and is engaged with the mounting section 543, the first plane 5431 of the mounting section 543 is engaged with the second plane 5611 of the mounting sleeve 561, such that the mounting sleeve 561 can't rotate with respect to the mounting section 543, thereby achieving the fixed mounting between the suction pipe mounting seat 56 and the mounting section 543.

In disassembly, the mounting sleeve 561 of the suction pipe mounting seat 56 passes through the pivot section 542 which is connected to the mounting section 543 and is taken out of the mounting section 543, such that there is detachable fixed mounting between the suction pipe mounting seat 56 and the mounting section 543.

Referring to FIG. 6, in this embodiment, the suction pipe mounting seat main body 562 comprises a baseplate 5621, two side plates 5622, and a mounting groove 5623 surrounded by the baseplate 5621 and the two side plates 5622 and configured to accommodate the suction pipe 53, at least one side plate 5622 comprises a suction pipe limit card 5624 extending toward the mounting groove 5623 and configured to limit the suction pipe 53, thereby preventing the suction pipe 53 from separating from the suction pipe mounting seat 56.

Referring to FIGS. 4-6, the suction pipe 53 is arranged to make a suction opening thereof be lower than the water level in the water tank 2 when the float 51 floats on the surface of the water in the water tank 2. In this embodiment, a strainer mesh 531 is mounted on a distal end of the suction pipe 53, the suction pipe 53 is inclined downward with respect to the first connecting part 55 along the direction away from the rotation shaft 54, such that the strainer mesh 531 on the distal end of the suction pipe 53 is lower than the float 51, and therefore the distal end of the suction pipe 53 always extends into the water in the water tank 2 when the float 51 floats on the surface of the water in the water tank 2.

What described above are only preferred embodiments of the present invention but are not intended to limit the scope of the present invention, any equivalent structure or equivalent process transformations made by learning the specification and the drawings of the present invention, whether applied to other related technical fields directly or indirectly, should be included in the protection scope of the present invention.

What is claimed is:

1. A float assembly of a dehumidifier, wherein the dehumidifier comprises a housing, a draining pump, and a water tank, the housing comprises an accommodating cavity configured for accommodating the water tank, an outlet configured for allowing the water tank in and out of the housing, a first side wall being opposite to the outlet, and a microswitch mounted on the first side wall and configured to control the draining pump;

the float assembly comprising:

a float disposed in the water tank, a press plate configured to trigger the microswitch, a suction pipe communicating with the draining pump and configured to drain water in the water tank, and a rotation shaft rotatably connected to the housing;

the float, the suction pipe, and the press plate are fixedly connected to the rotation shaft respectively, the suction pipe and the float are arranged at a same side of the rotation shaft, so that the suction pipe is driven by the float to synchronously rise up or fall down along with variation of a water level in the water tank;

the suction pipe is movable between a first position and a second position, the press plate has a first state in which the press plate leaves the microswitch and a second state in which the press plate presses the microswitch, when the suction pipe moves from the second position to the first position, the press plate changes from the second state to the first state.

2. The float assembly of the dehumidifier of claim 1, wherein, the float assembly of the dehumidifier further comprises a first connecting part connecting the rotation shaft with the float, the rotation shaft comprises a main section connected to the first connecting part and the press plate, and two pivot sections disposed on two ends of the main section and rotatably connected to the housing; a mounting section configured to fixedly mount the suction pipe is disposed between one pivot section and the main section.

3. The float assembly of the dehumidifier of claim 2, wherein, the suction pipe is inclined downward with respect to the first connecting part along a direction away from the rotation shaft.

4. The float assembly of the dehumidifier of claim 2, wherein, the float assembly of the dehumidifier further comprises a suction pipe mounting seat, the suction pipe mounting seat comprises a mounting sleeve engaged with and fixedly connected to the mounting section, a suction pipe mounting seat main body for mounting the suction pipe, the mounting section comprises a side surface engaged with an inner wall of the mounting sleeve, the side surface of the mounting section comprises at least one first plane, and the inner wall of the mounting sleeve comprises a second plane engaged with the first plane.

5. The float assembly of the dehumidifier of claim 4, wherein, the suction pipe mounting seat main body comprises a baseplate, two side plates, and a mounting groove surrounded by the baseplate and the two side plates and configured to accommodate the suction pipe, at least one side plate comprises a suction pipe limit card extending toward the mounting groove and configured to limit the suction pipe.

6. The float assembly of the dehumidifier of claim 2, wherein, the accommodating cavity further comprises a top wall, a barb is mounted on the top wall, a top surface of the first connecting part is provided with a hook matched with the barb, and the hook is configured to hang the float on the barb.

7. The float assembly of the dehumidifier of claim 6, wherein, a bottom surface of the first connecting part is provided with a pushing part, the pushing part comprises a jacking surface inclined downward gradually along a direction from the rotation shaft to the float, at least a part of the jacking surface is disposed in the water tank, and the jacking surface is arranged to be pushed by a periphery of the water tank when the water tank is moved from the accommodating cavity to the outlet, such that the hook moves upward to be hung on the barb.

8. The float assembly of the dehumidifier of claim 7, wherein, the water tank comprises a top opening, an upper peripheral of the top opening presses the jacking surface of the pushing part when the water tank is moved towards the outlet and taken out of the accommodating cavity.

9. The float assembly of the dehumidifier of claim 2, wherein, an included angle between the press plate and the first connecting part is an acute angle, an upper end of the press plate is connected to the rotation shaft, and a lower end of the press plate is pressed by the water tank to rotate toward the microswitch when the press plate is in the first state and the water tank is moved toward the accommodating cavity.

10. The float assembly of the dehumidifier of claim 2, wherein, the first connecting part is plate shaped.

11. The float assembly of the dehumidifier of claim 2, wherein, a surface of the press plate which is opposite to the microswitch is provided with a hollow strengthened part.

12. The float assembly of the dehumidifier of claim 2, wherein, an included angle between the press plate and the first connecting part is an obtuse angle, a lower end of the press plate is connected to the rotation shaft.

13. The float assembly of the dehumidifier of claim 1, wherein, the suction pipe is arranged to make a suction opening of the suction pipe be lower than the water level in the water tank when the float floats on a surface of the water in the water tank.

14. The float assembly of the dehumidifier of claim 1, wherein, the first side wall is further provided with two opposite rotation shaft mounting seats disposed above the microswitch.

15. The float assembly of the dehumidifier of claim 1, wherein, the float is a casing with an upper opening, a closed casing or a solid object with small density.

16. The float assembly of the dehumidifier of claim 1, wherein, a strainer mesh is mounted on a distal end of the suction pipe.

17. A dehumidifier, comprising:

a housing, a draining pump, a water tank, and a float assembly, the housing comprises:

an accommodating cavity configured for accommodating the water tank, an outlet configured for allowing the water tank in and out of the housing, a first side wall being opposite to the outlet, and a microswitch mounted on the first side wall and configured to control the draining pump;

the float assembly comprises:

a float disposed in the water tank, a press plate configured to trigger the microswitch, a suction pipe communicating with the draining pump and configured to drain water in the water tank, and a rotation shaft rotatably connected to the housing;

the float, the suction pipe, and the press plate are fixedly connected to the rotation shaft respectively, the suction pipe and the float are arranged at a same side of the rotation shaft, so that the suction pipe is driven by the float to synchronously rise up or fall down along with variation of a water level in the water tank;

the suction pipe is movable between a first position and a second position, the press plate has a first state in which the press plate leaves the microswitch and a second state in which the press plate presses the microswitch, when the suction pipe moves from the second position to the first position, the press plate changes from the second state to the first state.

* * * * *